US006406020B1

(12) United States Patent
Reed

(10) Patent No.: US 6,406,020 B1
(45) Date of Patent: Jun. 18, 2002

(54) CASINO CARD GAME AND METHOD OF PLAYING THE SAME

(76) Inventor: James E. Reed, 808 E. Hudson Cir., Spearfish, SD (US) 57783

( * ) Notice: Subject to any disclaimer, the term of this patent is extended or adjusted under 35 U.S.C. 154(b) by 0 days.

(21) Appl. No.: 09/532,854

(22) Filed: Mar. 22, 2000

Related U.S. Application Data

(60) Provisional application No. 60/126,146, filed on Mar. 25, 1999.

(51) Int. Cl.[7] ..... A63F 1/00
(52) U.S. Cl. ..... 273/274; 463/11; 273/292
(58) Field of Search ..... 273/279, 292; 463/12, 13, 11

(56) References Cited

U.S. PATENT DOCUMENTS 5,413,353 A 5/1995 Demarest
5,452,899 A * 9/1995 Skratulia
5,584,486 A * 12/1996 Franklin
5,685,774 A 11/1997 Webb
5,810,663 A * 9/1998 Bochichio
5,813,673 A * 9/1998 Richardson
6,135,453 A * 10/2000 Srichayaporn

* cited by examiner

*Primary Examiner*—Benjamin H. Layno
*Assistant Examiner*—V K Mendiratta
(74) *Attorney, Agent, or Firm*—Ralph F. Crandell

(57) ABSTRACT

A method of playing a card game particularly adapted for casino wagering. The game uses one or more standard fifty-two card decks and involves a banker, a dealer and one or more players. The player has the option of wagering against a banker's high hand, low hand or both by placing an ANTE bet or bets. The dealer deals two cards to each player placing an ANTE bet and three cards to the banker. After viewing the dealt hand, a player has the option of surrendering his ANTE bet or bets or placing a PLAY bet or bets. Winning hands are determined by the numerical value of the cards held by the player as compared to the numerical value of the cards held by the banker. Bonus payoffs are paid to the player if the player's hand qualifies as a certain predefined high or low hand. A Jackpot to be paid for a certain defined hand may be employed.

10 Claims, 5 Drawing Sheets

CASINO CARD GAME AND METHOD OF PLAYING THE SAME

CROSS REFERENCE TO RELATED APPLICATION

This application claims the benefit of Provisional Application Ser. No. 60/126,146, filed Mar. 25, 1999, by James E. Reed, for "Casino Card Game and Method of Playing The Same."

BACKGROUND OF THE INVENTION

1. Field of the Invention

The present invention relates to a card game finding particular but not exclusive suitability for use in a casino. More specifically, the present invention relates to a card game in which the outcome is dependent upon the numerical summation of plural card values, and is further dependent on The frequency of occurrence of card combinations.

2. Description of the Prior Art

Casinos and other gaming establishments are in the business of providing wagering games to their clientele. Such games are designed to enable each player to place a bet against the house or another player. In certain jurisdictions and games, most wagering is against the casino or house, and the casino acts as the banker. In other jurisdictions and games, the casino can have no interest in the outcome of the wager and wagering is among the players. In the latter case, the casino may charge a fee to the players, such as in the form of a unit or percentage charge per hand or a time charge, that is a fixed charge per hour at the table. Chips or counters may be sold by the casino to the players to facilitate the placing of wagers.

In games in which the casino or house is the banker, if a player loses the casino collects the money, or if a player wins the casino pays the money. In games in which a player may be the banker, each player in turn has the option of acting as the banker, provided that the player opting to be the banker has sufficient chips on the playing table to cover all losses for the hand in which the player is the banker. Again, if a player loses the player-banker collects the money, and if a player wins the player-banker pays the money, including "bonus" payoffs.

Ante bets are bets made before a player is dealt a hand. In a Hi-Lo game, that is a game involving both high and low hands, a player has the option of placing a Hi ante bet, a Lo ante bet, or both, to be eligible to participate in the game. Play bets are bets made after viewing the hand dealt. In a Hi-Lo game, a player has the further option of either placing a Hi play bet, a Lo play bet, or both betting that the player's hand will beat the banker's hand, or surrendering the Hi and/or Lo ante bet.

If a jackpot option is used in the game for the holder or holders of a pre-defined combination, the jackpot is paid to players holding such a combination from the jackpot of money accumulated according to the game rules, usually from portions of surrendered bets.

A high-low card game in which players are dealt three cards and a dealer is dealt four cards, and hand rankings are determined according to poker values, is disclosed in U.S. Pat. No. 5,810,663, issued Sep. 22, 1998, to J. Bochichio. The players' hands are compared with the dealer's hand and bets are paid or lost accordingly.

A 3-card, multiple deck, poker rank type card game is described in U.S. Pat. No. 5,685,774, issued Nov. 11, 1997, to D. J. Webb for "Method of Playing a Card Game." This game includes a bonus payment according to a predetermined schedule provided that the player elects to play for the bonus.

A blackjack type card game is described in U.S. Pat. No. 5,413,353, issued May 9, 1995, to P. W. Demarest for "Method of Playing a Blackjack Type Card Game." The players play against each other and a predetermined schedule sets the payoffs.

SUMMARY OF THE INVENTION

The present invention is a new card game embodied in a new method of playing a card game that includes a dealer, a banker and one or more players, and involves the steps of establishing a numerical hierarchy of possible hands based on counting and summing the numerical value of two dealt cards to a player to determine winning hands, providing a player with a number of wagering options including the placing of Hi and Lo ante and play bets, and resolving wagers of the player as compared to the numerical value of the best two of three cards dealt to the banker.

The game embodying the present invention involves the following actions:

(a) HI or LO ANTE bets: A player makes an ANTE bet or bets and is dealt a hand. After viewing the hand, the player either surrenders the ANTE bet or bets, or places a PLAY bet or bets that the hand will beat the banker's hand.

(b) HI or LO PLAY bets: The player's hand and the dealer's hand are compared. A player will win or lose the ANTE and PLAY bet or bets, depending on the numerical value of the player's hand as compared to the value of the banker's hand.

(c) BONUS payoff: A player will be paid a BONUS payoff according to a predetermined schedule if the player's hand is one of certain pre-established values.

(d) JACKPOT payoff: If the JACKPOT option is employed, the amount accumulated from surrendered ANTE bets are placed in a JACKPOT and paid to any player having a hand containing the pre-defined JACKPOT hand. To establish a JACKPOT, the amount of each surrendered ANTE bet is divided between the banker and the JACKPOT as determined by the rules of the game and casino. For example, the split may be 50% to the JACKPOT and 50% to the banker.

The present invention is further embodied in an apparatus for use in playing the card game. The apparatus comprises a gaming table or table cover presenting a display of playing areas. The apparatus comprises a rigid playing surface of board, plastic or other suitable material or alternatively comprise a cloth or other flexible material defining a playing surface. The surface is of generally semi-circular form, with the dealer's playing area being located proximate the straight edge of the playing surface or centrally thereof and the players' playing areas being disposed side by side in an array adjacent the curved edge of the playing surface. The areas include:

(a) a dealer's area;

(b) a number of player playing areas, each comprising a zone in which a player may place wagers as described above, and another zone adapted to receive the cards dealt the player;

(c) a chip tray for holding playing chips in a position convenient to the dealer or banker;

(d) an area or receptacle for cards not in play; and (e) if the JACKPOT option is employed, a box to hold chips placed in the JACKPOT.

DESCRIPTION OF THE PREFERRED EMBODIMENT

Figure 1:
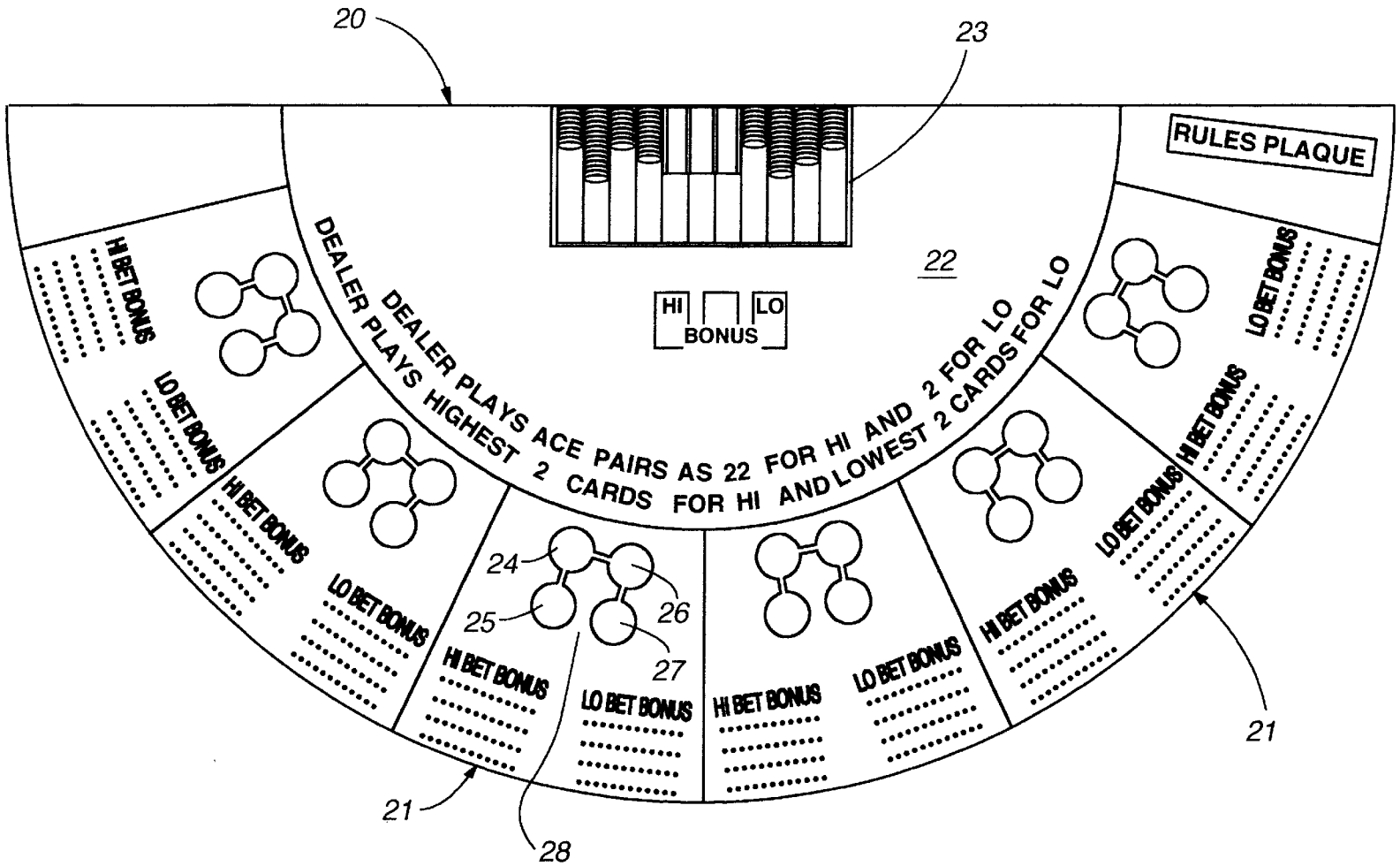
FIG. 1 is a plan view of a gaming table for playing the card game embodying the present invention.
Figure 2A:
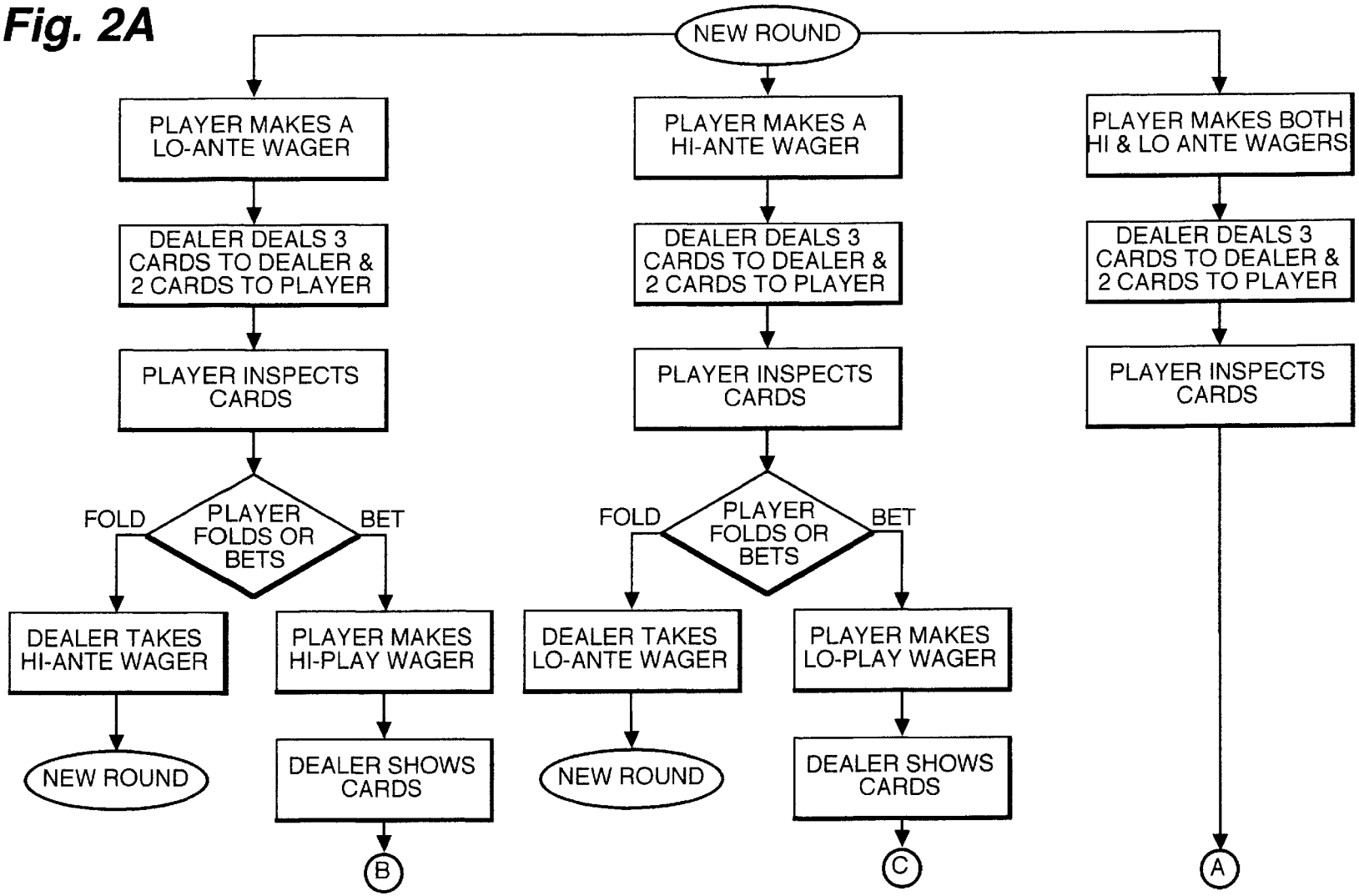
FIGS. 2A, 2B, 2C and 2D combined show a flow diagram of the steps involved in playing the card game embodying the present invention.
Figure 2B:
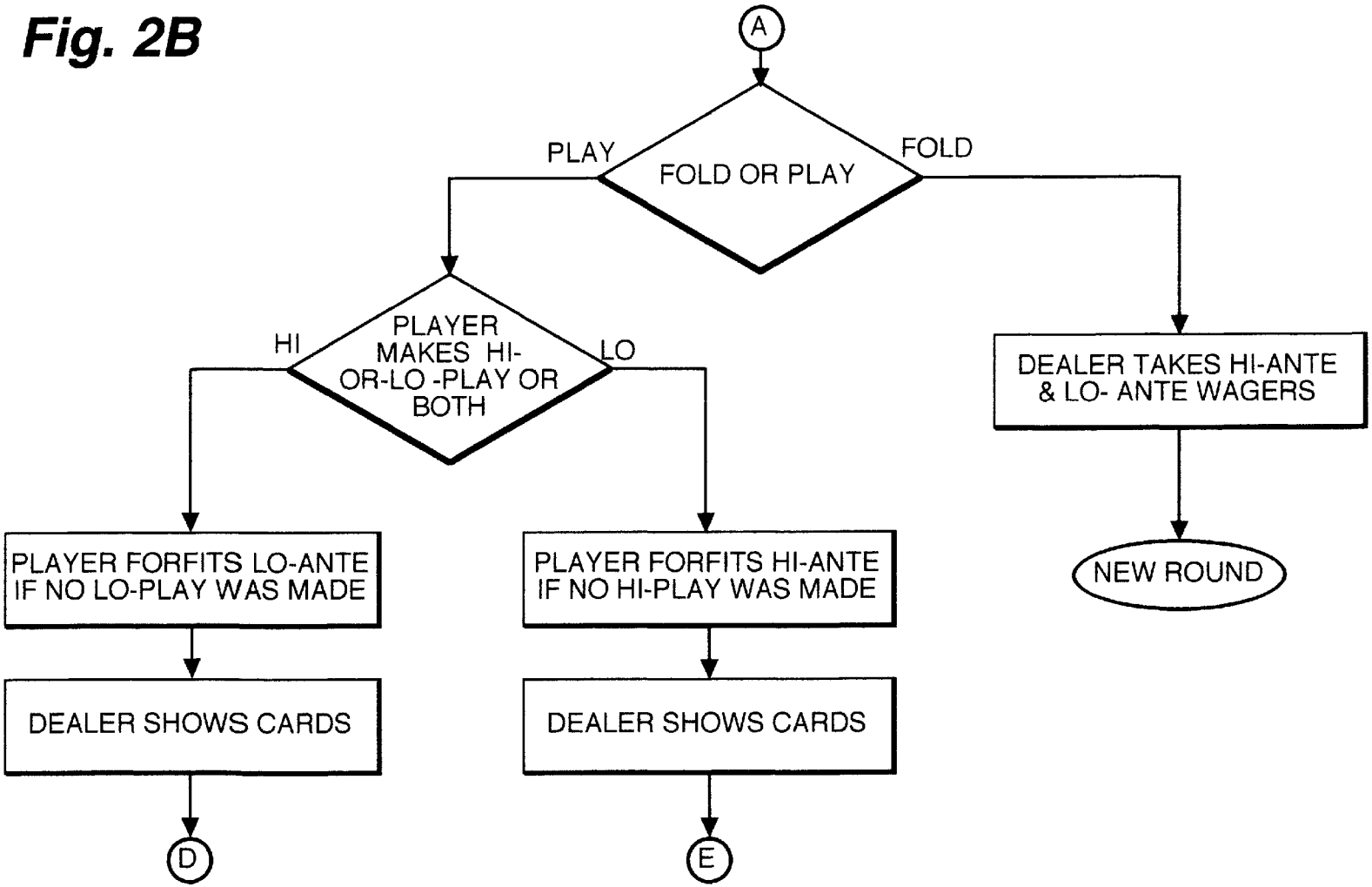
Figure 2C:
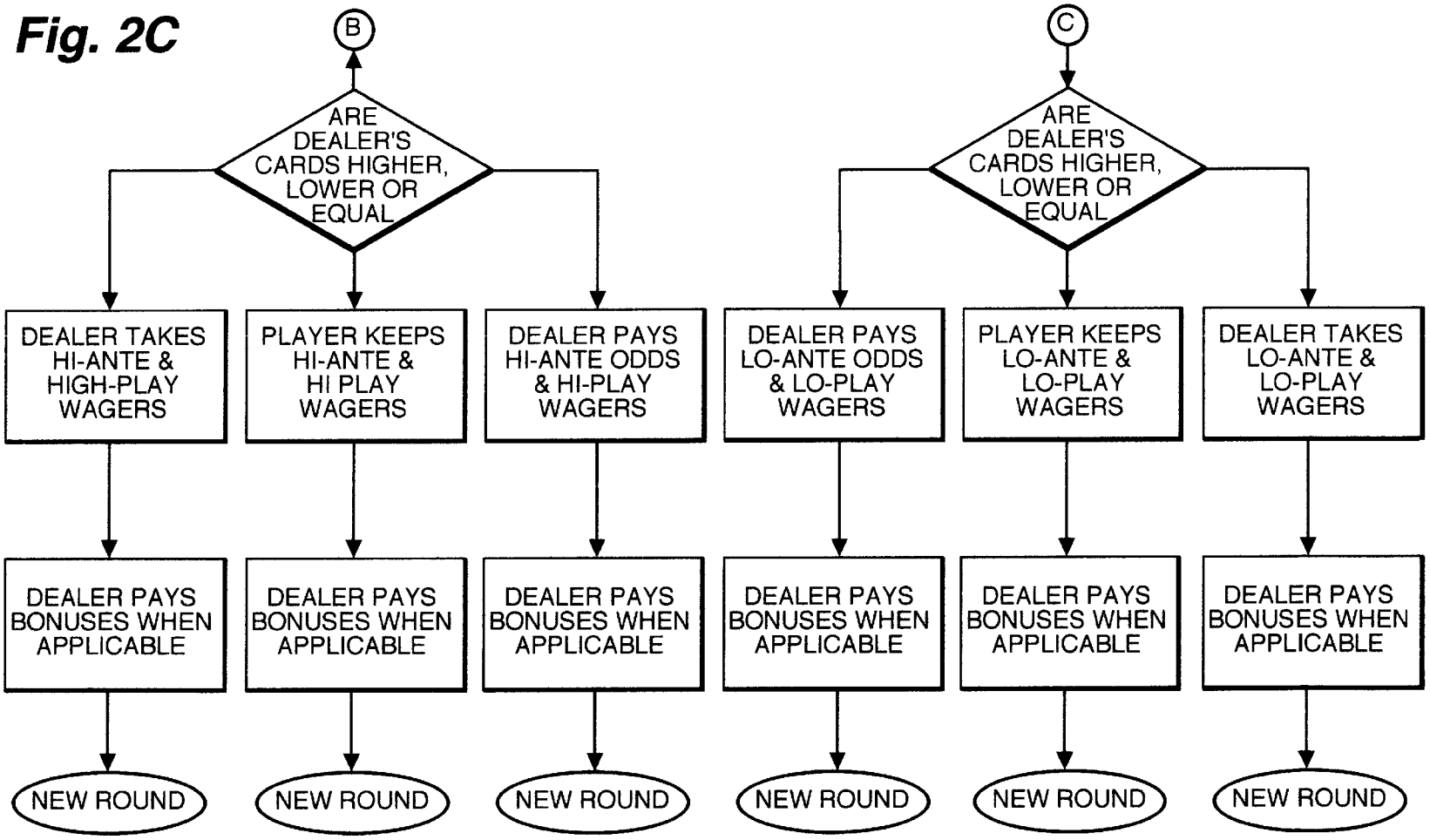
Figure 2D:
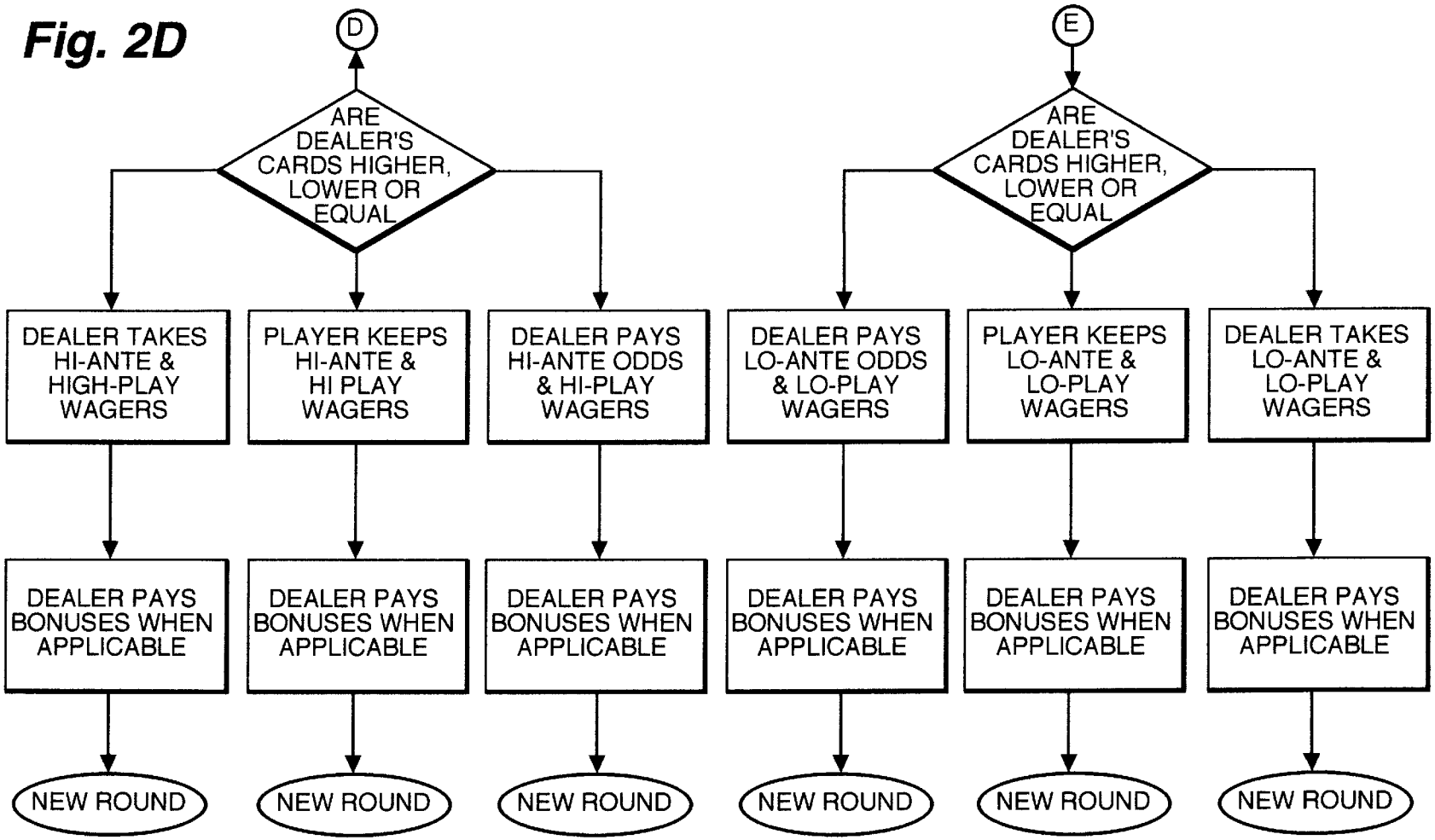

A playing surface or table layout 20 for playing a game embodying the present invention is shown in FIG. 1. The layout may be marked on any suitable surface such as a gaming table. For example, the layout may be in form of a layout cloth supported on a suitable surface. The layout provides playing areas 21 for a number of players, typically, six or seven players, and a separate area 22 for a house dealer, who also typically acts as the banker. A chip tray 23 is conventionally provided for the banker. Each playing area 21 has a number of marked bet zones 24, 25, 26 and 27 for use in the placement of various wagers by a player. A card zone 28 is provided for the player's cards. Each player takes a place at one of the player areas 21 of the game table.

The game is played in a number of rounds. In each round, each player has the option of playing against the banker. Instead of the house acting as the banker, one of the players may act as banker. Where a player acts as the banker, a button or token (not shown) may be used to so indicate. The button is passed from player to player to indicate which player is acting as banker. To qualify as a banker, the player must have sufficient chips on the table to cover all wagers of the other players. Any player may decline to act as banker by passing the button to the next player in rotation.

At the commencement of a new round of the game embodying the present invention, as shown in the flow diagram presented in FIGS. 2A, 2B, 2C, and 2D, each player decides whether to play the round by wagering against the banker's high hand or low hand or both. To be eligible to bet against the banker's hand, a player makes either a HI ANTE bet by placing gaming chips in the player's HI ANTE zone 24 on the table, or a LO ANTE bet by placing chips in the LO ANTE zone 26, or both HI and LO ante bets.

When the ANTE bet or bets are in place, the dealer deals a two card hand to each player and a three card hand to the banker. The cards may initially be dealt to the players face up or face down. The banker's cards are dealt three cards face down.

In the game embodying the present invention, the cards are valued numerically. In this system, aces count as either 11 or 1, face cards are counted as 10, and the remaining cards are counted at face value. The value of a player's hand is determined by adding the values of the two cards making up the hand.

For example, where A=Ace, K=King, Q=Queen, and J=Jack:

A=1 or 11

K, Q, and J=10

A+A=22 or 2

A+10, A+J, A+Q, A+K=21

K+10, Q+J, 10+10, etc.=20

A+3, 2+2=4 and so on. The numerical value of the selected cards of the banker's hand is calculated in like manner.

When cards have been dealt, any player who has placed a HI ANTE bet or a LO ANTE bet or both inspects the dealt hand and determines whether either to surrender the HI ANTE wager or LO ANTE wager or both, or to continue to play either or both. To continue, the player places a HI PLAY wager or a LO PLAY wager or both. The PLAY wagers must be the same as the ANTE wagers. The HI PLAY wager is made by placing appropriate chips on the HI PLAY zone 25, and the LO PLAY wager is made by placing appropriate chips on the LO PLAY zone 27. When the wager has been completed, the player places the cards in the card zone 28.

If a player surrenders either ANTE wager, the banker takes the player's surrendered bet. If both HI and LO bets are surrendered, the player's cards are collected by the dealer before the game proceeds. If the JACKPOT option is employed, the surrendered ANTE bets are apportioned between the banker and the JACKPOT according to preestablished rules.

When all bets are completed or surrendered, the banker's cards are exposed. Using the three card banker's hand, the banker will play the highest two cards for high and the lowest two cards for low. For example, if the banker's cards are A-A-K, the hand has a numerical high value of 22 and a numerical low value of 2. If the cards are A-K-2, the hand has a numerical high of 21 and a numerical low of 3.

The dealer then in turn reveals each player's hand, if not already visible, and resolves each player's wager or wagers according to the calculated numerical value of each hand. For example, if the cards are A-3, the hand has a high value of 14 and a low value of 4. A hand of 6-9 has both a high and a low value of 15. The banker pays or collects wagers according to the value of the banker's hand as compared to the value of each player's hand.

In order to vary the odds either in favor of the players or the house, provisions may be made for BONUS payouts. The banker pays the defined BONUS payouts for defined BONUS hands when the player has made both ANTE and PLAY bets, regardless of whether the player has won or lost with respect to the banker. For example bonus hands may be established as follows:

| Hand Value | Pay-off |
|---|---|
| HI BONUS | |
| 22 | 20 to 1 |
| 21 | 4 to 1 |
| 20 (pairs only) | 2 to 1 |
| Aces play as 11 | |
| LO BONUS | |
| 2 | 20 to 1 |
| 3 & 4 | 4 to 1 |
| 5 | 3 to 1 |
| Aces play as 1 | |

Alternative bonus schedules may be adopted to increase or decrease payouts.

If the JACKPOT option is employed, and if a pre-defined JACKPOT hand has been dealt, the dealer pays out the accumulated JACKPOT to the holder or holders of such a hand.

There are a variety of embodiments of the present invention. In addition to the use of actual playing cards, the use of images of playing card displayed mechanically, electromechanically, electrically or otherwise is within the scope of the present invention. For example, the scope would include the display of playing cards on a board game, on a mechanical slot machine, on an electronic gaming device, on a video screen, on a computer display screen, or utilizing another form of image generation such as a holography. In addition it is within the scope of the present invention to use two or more decks of playing cards. It is also within the scope of the present invention to employ 'wild' cards such as a joker or naming a deuce or other card as wild with a predetermined numerical value or values.

For a casino game to be successful for the casino, the odds or expectations must favor the house but not be so unfavorable to the player as to discourage players from playing. By the use of appropriate bonus payment schedules and/or jackpots, the return to the player can be varied. The game as described is fun and attractive to players because the game is simple and easy to play, and is fast and exciting.

The game is also suitable for private or home play, requiring only a deck or two of cards, chips, and a printed tablecloth or game board. In such private games one of the players acts as banker and dealer, much like the home play of Black Jack.

As will be apparent from the foregoing description, those skilled in the art will appreciate that various modifications may be made without departing from the scope of the invention. For example, the naming of the wagers, the naming or ranking of any hand, the BONUS payoff schedule and predetermined winning or losing ranks, may be varied in accordance with the requirements or rules of a particular casino or game host. The table layout likewise may be varied from that described and shown to provide for card table play.

What is claimed is:

1. A method of playing a card game adapted for wagering using one or more standard fifty-two card decks and involving a banker, a dealer and one or more players, comprising the steps of:

a) each player deciding to and placing a HI ANTE bet so that the player's hand will be eligible to play against the banker's high hand and/or each player deciding to and placing a LO ANTE bet so that the player's hand will be eligible to play against the banker's low hand;

b) the dealer dealing two cards face down to each player and three cards face down to the banker;

c) each player who placed a HI ANTE bet deciding before viewing the banker's hand either to surrender the HI ANTE bet or to continue play by placing a HI PLAY bet equal to the amount of the HI ANTE bet;

d) each player who placed a LO ANTE bet deciding before viewing the banker's hand either to surrender the LO ANTE bet or to continue play by placing a LO PLAY bet equal to the amount of the LO ANTE bet;

e) turning the banker's cards face up;

f) the banker playing the numerically highest two of the three cards as a high hand and the numerically lowest two of the three cards as a low hand;

g) determining whether the banker's high hand is a numerically higher or numerically lower hand than each player's high hand;

h) paying the player's HI ANTE and HI PLAY bets to the banker if the banker's high hand is numerically higher than a player's high hand, paying the player an amount equal to the total of the player's HI ANTE and HI PLAY bets if the banker's high hand is numerically lower than the player's high hand, and declaring the deal a draw if the banker's high hand numerically equals a player's high hand with the player retaining the bets;

i) determining whether banker's low hand is a numerically higher or numerically lower hand than a player's low hand;

j) paying the player's LO ANTE and LO PLAY bets to the banker if the banker's low hand is numerically lower than a player's low hand, paying to the player an amount equal to the total of the player's LO ANTE and LO PLAY bets if the banker's low hand is numerically higher than a player's low hand, and declaring the deal a draw if the banker's low hand numerically equals a player's low hand with the player retaining the bets.

2. A method of playing a card game according to claim 1 wherein the cards are numerically valued according to the following scale:

a) A or Ace=11 or 1, K or King=10, Q or Queen=10, J or Jack=10 and cards 2 through 10=the face value;

b) The numerical value of a hand is determined by summing the value of the two cards composing the hand.

3. A method of playing a card game according to claim 1 wherein BONUS payoffs are paid by the banker to each player who has made an ANTE bet and a PLAY bet and whose hand is one of a predetermined number of specified ranking bonus hands.

4. A method as defined in claim 3 wherein the ranking high hands and pay-offs are as follows:

| Hand Value | Pay-off |
|---|---|
| 22 | 20 to 1 |
| 21 | 4 to 1 |
| 20 (pairs only) | 2 to 1 |
| Aces play as 11. | |

5. A method as defined in claim 3 wherein the ranking low hands and pay-offs are as follows:

| Hand Value | Pay-off |
|---|---|
| 2 | 20 to 1 |
| 3 & 4 | 4 to 1 |
| 5 | 3 to 1 |
| Aces play as 1. | |

6. A method of playing a card game as defined in claim 1 wherein if a player surrenders the HI ANTE bet or LO ANTE bet or both, a predetermined portion of the surrendered bet is placed in a JACKPOT and the remaining portion is paid to the banker.

7. A method of playing a card game according to claim 6 wherein said JACKPOT is paid by the banker to each player who has made an ANTE bet and a PLAY bet and whose hand is a predetermined specified jackpot hand.

8. A method of playing a card game adapted for wagering using one or more standard fifty-two card decks and involving a banker, a dealer and one or more players, comprising the steps of:

a) each player deciding to and placing a HI ANTE bet so that the player's hand will be eligible to play against the banker's high hand and/or each player deciding to and placing a LO ANTE bet so that the player's hand will be eligible to play against the banker's low hand;

b) the dealer dealing two cards face down to each player and three cards to the banker, the banker's cards being dealt all face down or two face down and one face up;

c) each player who placed a HI ANTE bet deciding before viewing the banker's hand either to surrender the HI ANTE bet or to continue play by placing a HI PLAY bet equal to the amount of the HI ANTE bet;

d) each player who placed a LO ANTE bet deciding before viewing the banker's hand either to surrender the LO ANTE bet or to continue play by placing a LO PLAY bet equal to the amount of the LO ANTE bet;

e) turning the banker's cards face up;

f) the banker playing the numerically highest two of the three cards as a high hand and the numerically lowest two of the three cards as a low hand;

g) determining whether the banker's high hand is a numerically higher or numerically lower hand than each player's high hand;

h) paying the player's HI ANTE and HI PLAY bets to the banker if the banker's high hand is numerically higher than a player's high hand, paying the player an amount equal to the total of the player's HI ANTE and HI PLAY bets if the banker's high hand is numerically lower than the player's high hand, and declaring the deal a draw if the banker's high hand numerically equals a player's high hand with the player retaining the bets;

i) determining whether banker's low hand is a numerically higher or numerically lower hand than a player's low hand;

j) paying the player's LO ANTE and LO PLAY bets to the banker if the banker's low hand is numerically lower than a player's low hand, paying to the player an amount equal to the total of the player's LO ANTE and LO PLAY bets if the banker's low hand is numerically higher than a player's low hand, and declaring the deal a draw if the banker's low hand numerically equals a player's low hand with the player retaining the bets; and (k) paying a BONUS to each player who has made an ANTE bet and a PLAY bet and whose hand is one of a predetermined number of specified ranking bonus hands.

9. A method of playing a card game as defined in claim 8 wherein if a player surrenders the HI ANTE bet or LO ANTE bet or both, a predetermined portion of the surrendered bet is placed in a JACKPOT and the remaining portion is paid to the banker.

10. A method of playing a card game according to claim 9 wherein said JACKPOT is paid by the banker to each player who has made an ANTE bet and a PLAY bet and whose hand is a predetermined specified jackpot hand.

* * * * *